United States Patent [19]

Winslow

[11] 4,334,376

[45] Jun. 15, 1982

[54] PERCUSSION CAP REMOVER

[75] Inventor: Jack M. Winslow, Caldwell, Id.

[73] Assignees: Amanda Kimberly Winslow; Marjorie Ann Winslow; Francis Mae Winslow; Jennifer Jean Winslow; Marjorie Ellen Winslow, all of Caldwell, Id.

[21] Appl. No.: 136,092

[22] Filed: Mar. 31, 1980

[51] Int. Cl.[3] ..... F41C 27/00

[52] U.S. Cl. ..... 42/90; 81/3.05; 29/267; 254/131

[58] Field of Search ..... 81/3.05, 3 R, 53.2; 29/267, 231; 42/90; 254/21, 25, 131

[56] References Cited

U.S. PATENT DOCUMENTS

| | | | |
|---|---|---|---|
| 209,989 | 11/1878 | Shinn | 81/3.05 |
| 354,157 | 12/1886 | MacMillan | 81/3.05 |
| 441,316 | 11/1890 | Montgomery | 254/26 R |
| 1,280,549 | 10/1918 | Reynolds | 145/46 |
| 1,892,824 | 1/1933 | Ziegler et al. | 29/267 |
| 2,228,962 | 1/1941 | Maney | 254/25 |
| 2,640,382 | 6/1953 | Grossman | 81/13 |
| 2,802,211 | 8/1957 | Friedman | 145/46 |
| 3,579,678 | 5/1971 | Regan | 7/158 |
| 4,123,868 | 11/1978 | Wilson | 42/90 |
| 4,123,882 | 11/1978 | Case et al. | 81/3 R |
| 4,135,322 | 1/1979 | Tice | 42/90 |

*Primary Examiner*—Roscoe V. Parker
*Attorney, Agent, or Firm*—Spencer & Kaye

[57] ABSTRACT

A device for removing a percussion cap from the primer nipple of a firearm comprising a bifurcated plate with a pair of substantially co-planar arms defining an elongated slot therebetween. The slot is open at one end of the plate and closed at the other. The inner edges of the arms are tapered at a predetermined angle, so that distance between the arms decreases from the lower surface to the upper surface of the plate. At the upper surface, this distance is less than the outside diameter of the cap at its skirt, but greater than the diameter of the nipple at the point where the nipple meets the skirt. A handle is joined to the plate at an angle at which sufficient leverage can be generated to remove the percussion cap.

9 Claims, 5 Drawing Figures

FIG 1
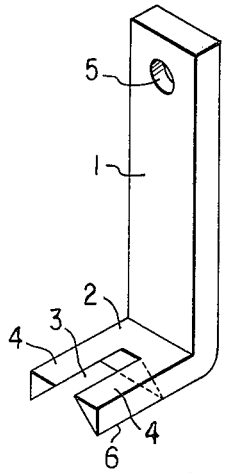
FIG 2
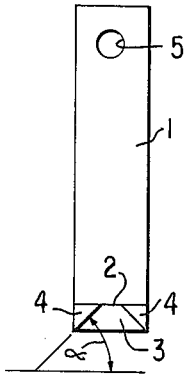
FIG. 3
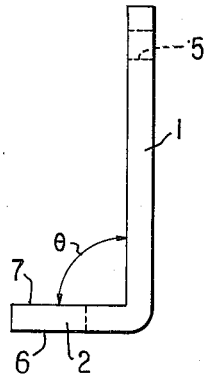
FIG. 4
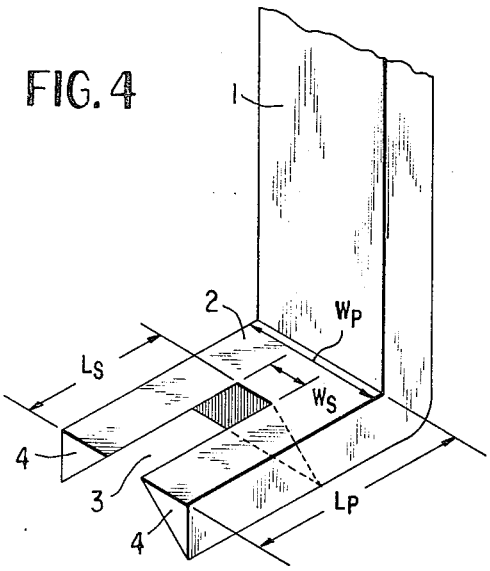
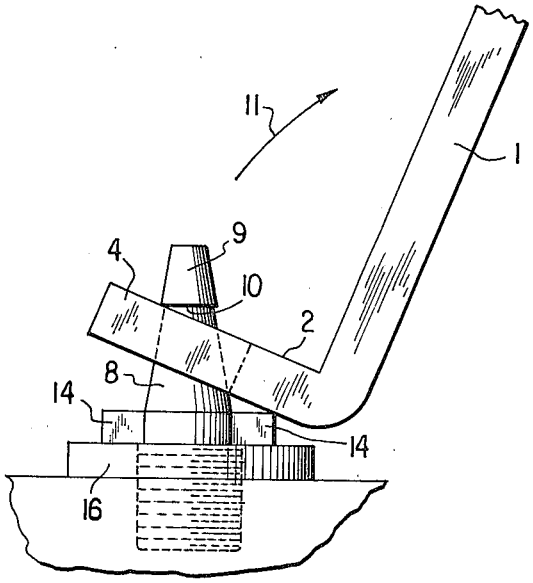
FIG. 5

PERCUSSION CAP REMOVER

BACKGROUND OF THE INVENTION

The present invention relates to firearms which use percussion caps, such as muzzle loading firearms, and more particularly to a device for removing a percussion cap from the primer nipple of a muzzle loading firearm.

In recent years, there has been increasing interest in the use of muzzle loading firearms. In loading this type of firearm, a preselected amount of black powder is placed within the barrel. Then, a projectile is placed in the barrel and compressed against the powder at the base of the barrel. This projectile can be a round ball enclosed in a lubricated patch, or a special type of ball or bullet, such as a self-expanding or self-grooving bullet. A percussion cap is then placed on the primer nipple to prepare the gun for shooting.

After continued use of such a firearm, the nipple vent may become plugged, especially if the cap is not sealed against moisture. Eventually the firearm may misfire, with the cap being wedged tightly onto the nipple by the force of the hammer. It is thus necessary to remove the cap with the gun loaded. Additionally, the user may wish to disarm a loaded gun for other reasons by removal of the cap.

In the past, the user of the weapon would lay the weapon down and remove the cap with a pair of pliers, or remove the cap by cutting it off with a knife. This method presents a serious safety hazard, with the weapon still loaded, since it may cause an accidental discharge. It is especially dangerous when an inexperienced user crushes or cuts into the charge in the percussion cap. A need has therefore arisen for an improved method of removing a percussion cap from the primer nipple of a muzzle loading firearm.

SUMMARY OF THE INVENTION

It is an object of the present invention to enable the safe removal of a percussion cap from the primer nipple of a firearm even with the firearm fully loaded with black powder and projectile.

It is a further object of the present invention to provide a convenient device for the removal of a percussion cap from the primer nipple of a firearm.

In order to achieve these objects and in accordance with its purpose, the present invention provides a device for removing a percussion cap from the primer nipple of a firearm, comprising a bifurcated plate including a pair of substantially coplanar arms having inner edges defining an elongated slot therebetween. The slot is open at one end of the plate and closed at the other end. The inner edges of the arms are tapered at a predetermined angle, so that the distance between the arms at the upper surface of the plate is less than the distance between the arms at the lower surface of the plate, less than the outer diameter of the percussion cap at the skirt of the cap and greater than the diameter of the nipple at the point where the nipple meets the skirt of the cap. A handle is connected to the other end of the bifurcated plate, the angle between the handle and the upper surface of the plate being such that sufficient leverage to remove a cap may be generated.

In a preferred embodiment of the invention, the angle of taper of the edges is about 45°, and the angle between the handle and the upper surface of the bifurcated plate is 90°.

It is to be understood that both the foregoing general description and the following detailed description are exemplary, but are not restrictive of the invention.

BRIEF DESCRIPTION OF THE DRAWINGS

FIG. 1 is a perspective view of the percussion cap removal device of the invention.

FIG. 2 is a front view of the device.

FIG. 3 is a side view of the device.

FIG. 4 is a perspective view showing the dimensions of the bifurcated plate of the invention.

FIG. 5 is an illustration showing the device being used to remove a percussion cap from a primer nipple.

DESCRIPTION OF THE PREFERRED EMBODIMENTS

With reference to FIGS. 1-3, a percussion cap removal device is shown, comprising a bifurcated plate 2, and a handle 1 forming an angle $\theta$ of approximately 90° with the upper surface of the plate. The handle is rectangular in shape and substantially flat. The bifurcated plate 2 is provided with a pair of substantially coplanar arms 4, defining an elongated slot 3 therebetween open at one end and closed at the other, both the plate and the slot being rectangular in shape. The width of the slot decreases from the lower surface 6 to the upper surface 7 of the plate, the angle of taper $\alpha$ being about 45°. A hole 5 provided in handle 1 may be used to attach the device to a carrying strap.

FIG. 4 shows a top perspective view of plate 2 with various dimensions indicated. $W_p$ is the width of bifurcated plate 2, $L_p$ is the length of the plate, and $L_s$ is the length of slot 3. $W_s$ is the width of the slot; that is, the distance between arms 4 at the upper surface of the plate.

FIG. 5 shows the use of the device in removing a percussion cap 9 from nipple 8. The arms 4 of the device are placed around nipple 8 at a point just below skirt 10 of percussion cap 9. Movement of handle 1, which provides leverage, in the direction of arrow 11 causes force to be exerted by arms 4 on skirt 10 of cap 9, in a lifting action. In this way, enough force can be exerted to remove the cap from the nipple without crushing or cutting into the cap, greatly reducing the possibility of an accidental discharge of the firearm.

In use, the percussion cap removal device is supported by lugs 14 which are part of nipple 8 and used for nipple removal. Resting the closed end of plate 2 on a lug provides leverage for cap removal. In the case of under hammer rifles, a shield 16 which is provided around nipple 8, can be used as a support for the cap removal device.

An additional advantage of the present invention lies in the scraping action of the prongs. Scraping of the prongs on the cup of the hammer nose will remove fragments of fired caps and other fouling.

In manufacturing the percussion cap removal device, it is convenient to place a bend in a rectangular piece of metal of a width equal to the desired width of the handle. The bifurcated plate and the slot therein may be cut to the proper size before or after the bending. Alternatively, the handle and plate may be joined by any suitable means.

The device of the invention may be manufactured from brass plate, or any other convenient material of sufficient durability. A preferred material is sheet metal, of 3/16″ thickness.

The width of slot at the upper surface 7 of plate 2 must be less than the outer diameter of cap 9 at skirt 10.

The width of slot 3 must also be greater than the diameter of nipple 8, at the point where the nipple meets the skirt, so that arms 4 can be placed around the nipple. The width of the slot must, at all points, be greater than the diameter of the nipple at that point, so that the arms can be placed around the nipple. In typical embodiments, the dimension of a device according to the invention would be as follows:

| Weapon | Cap | $W_P$ | $L_P$ | $W_S$ | $L_S$ |
|---|---|---|---|---|---|
| pistol/ revolver | No. 11 | .34-.36" | .75" | .155" | .50" |
| rifle | No. 10 | .445" | .75" | .167" | .50" |
| musket/ rifle | Large musket caps | .450" | .75" | .225" | .50" |

The dimensions of handle 1 are chosen to provide leverage for removal of the cap. In one embodiment, the handle is 2" long×½" wide×3/16" in thickness. The handle may also take other shapes and configurations. The angle of attachment of the handle of 90°0 has also been chosen with regard to providing sufficient leverage.

It will be understood that the above description of the present invention is susceptible to various modification, changes and adaptations, and the same are intended to be comprehended within the meaning and range of equivalents of the appended claims.

What is claimed is:

1. A device for removing a percussion cap having a skirt from the primer nipple of a firearm, said nipple being provided with lugs spaced from said skirt, comprising:

a bifurcated plate including parallel upper and lower surfaces and a pair of substantially coplanar arms having opposing inner edges defining an elongated slot open at one end of said plate and closed at the other end, the distance between said inner edges at the upper surface of said plate being constant over the length of said slot and less than the distance between said inner edges at the lower surface of said plate, less than the outer diameter of said percussion cap at the skirt of said cap and greater than the diameter of said nipple at the point where the nipple meets the skirt of said cap, said inner edges forming predetermined angles with the upper surface of said plate; and a handle joined to the other end of said bifurcated plate, the angle between said handle and the upper surface of said plate being such that sufficient leverage may be generated to remove said cap, said percussion cap being removed from said primer nipple by resting the lower surface of said plate on a lug of said nipple with said nipple inside said elongated slot and the upper surface of said plate pressing against the skirt of said percussion cap, and rotating said handle about the contact area between the lower surface of said plate and said lug.

2. A device as defined in claim 1 wherein said predetermined angle is about 45°.

3. A device as defined in claim 1 wherein the angle between said handle and the upper surface of said plate is about 90°.

4. A device according to claim 2 wherein the angle between said handle and the upper surface of said plate is about 90°.

5. A device according to claim 1, suitable for the removal of No. 11 percussion caps, wherein the width of said plate is 0.34 to 0.36 inch and the distance between said arms at the upper surface of said plate is about 0.155 inch.

6. A device according to claim 1, suitable for removing No. 10 percussion caps, wherein the width of said plate is about 0.45 inch and the distance between said arms at the upper surface of said plate is about 0.167 inch.

7. A device according to claim 1, suitable for removing large musket percussion caps, wherein the width of said plate is about 0.45 inch and the distance between said arms at the top of the plate is about 0.225 inch.

8. A device according to claim 1, wherein the length of the handle is about 2 inches, the width of the handle is about ½ inch, the length of said plate is about ¾ inch and the length of said slot is about ½ inch.

9. A device according to claim 1, wherein the handle is provided with a hole for attachment of said device to a carrying device.

* * * * *